US007706707B2

(12) United States Patent
Minakuchi et al.

(10) Patent No.: US 7,706,707 B2
(45) Date of Patent: Apr. 27, 2010

(54) FIXING APPARATUS

(75) Inventors: Yasunori Minakuchi, Nara (JP); Yoshinobu Tateishi, Nara (JP); Toshiya Mikita, Osaka (JP); Michihiro Yamashita, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 11/823,155

(22) Filed: Jun. 27, 2007

(65) Prior Publication Data

US 2008/0003009 A1 Jan. 3, 2008

(30) Foreign Application Priority Data

Jun. 29, 2006 (JP) ..... 2006-179962

(51) Int. Cl.
*G03G 15/20* (2006.01)

(52) U.S. Cl. ..... 399/67; 399/69; 399/122; 399/320; 399/328; 399/329

(58) Field of Classification Search ..... 399/67, 399/122, 320, 328, 329, 69
See application file for complete search history.

(56) References Cited

U.S. PATENT DOCUMENTS 7,194,233 B2 * 3/2007 Wu et al. ..... 399/328
2005/0117942 A1 * 6/2005 Ishii et al. ..... 399/328
2005/0214043 A1 * 9/2005 Kameda ..... 399/328
2007/0212094 A1 * 9/2007 Asakura et al. ..... 399/69

FOREIGN PATENT DOCUMENTS

JP 2004-085601 3/2004
JP 2004-198659 7/2004
JP 2005-316421 11/2005

OTHER PUBLICATIONS

Machine Translation JP 2004-198659 cited by Applicants on IDS dated Jun. 27, 2007.*

* cited by examiner

*Primary Examiner*—David P Porta
*Assistant Examiner*—Bryan P Ready
(74) *Attorney, Agent, or Firm*—Edwards Angell Palmer & Dodge LLP; David G. Conlin; Peter J. Manus

(57) ABSTRACT

In one embodiment, in a standby mode, an endless heating belt is caused to move apart from a hot roller. Furthermore, in color mode, the endless heating belt is caused to contact the hot roller to make possible thermal conduction between the endless heating belt and the hot roller, and a surface temperature of the endless heating belt is adjusted within a prescribed range of 200° C. to 210° C. being higher than a fixing temperature of 180° C. Further still, in monochrome mode, a length (or a surface area) of a heating contact region between the endless heating belt and the hot roller is set to a maximum to increase a thermal conduction efficiency between the endless heating belt and the hot roller, and a surface temperature of the endless heating belt is adjusted within a prescribed range of 210° C. to 220° C. being sufficiently higher than the fixing temperature of 180° C.

8 Claims, 9 Drawing Sheets

FIXING APPARATUS

CROSS REFERENCE TO RELATED APPLICATIONS

This application claims priority under 35 U.S.C. §119(a) on Patent Application No. 2006-179962 filed in Japan on Jun. 29, 2006, the entire contents of which are hereby incorporated by reference.

BACKGROUND OF THE INVENTION

1. Field of the Invention

The present invention relates to fixing apparatuses that are applied in electrophotographic image forming apparatuses such as copiers, facsimile machines, and printers.

2. Description of the Related Art

Generally, in image forming apparatuses such as copiers, printers, and facsimile machines, an electrostatic latent image is formed on a photosensitive body, toner is supplied from a development apparatus to the photosensitive body, and a toner image is formed on the photosensitive body by the electrostatic latent image on the photosensitive body being developed by the toner. Thereafter, the toner image is transferred from the photosensitive body to a sheet of recording paper, and heat and pressure are applied to the sheet of recording paper to cause the toner image to be fixed to the sheet of recording paper.

In the fixing apparatus, the sheet of recording paper is sandwiched between a hot roller and a pressure roller (also referred to as fixing rollers) and subjected to heat and pressure, which causes the toner image to thermally fuse and become fixed onto the sheet of recording paper. To reliably fix the toner image onto the sheet of recording paper it is necessary to suitably regulate the surface temperature of the hot roller.

Incidentally, along with increased speeds in image forming apparatuses, increased speeds are also continuing to be achieved in fixing apparatuses. For example, in dual-use color and monochrome image forming apparatuses, there is a higher frequency usage of monochrome printing over color printing and since processing speed is given priority over image quality for monochrome printing, higher speeds of print processing are enabled more for monochrome print processing than color print processing, thereby increasing the usefulness for monochrome print processing. Specifically, when using standard A4 sheets of recording paper, the transport speed for the sheets of recording paper during color print processing is set to 41 sheets/minute (a processing speed of 225 mm/sec) and the transport speed for the sheets of recording paper during monochrome print processing is set to 70 sheets/minute (a processing speed of 350 mm/sec), thereby increasing the speed of monochrome print processing.

However, when switching the transport speed or processing speed for the sheet of recording paper in this manner, the surface temperature of the fixing rollers tends to drop for increases in the transport speed or processing speed for the sheet of recording paper, which makes deficiencies in fixing of the toner image onto the sheet of recording paper more likely to occur.

This is because a pass-through time of the sheet of recording paper passing through a nip region between the hot roller and the pressure roller becomes shorter for increases in the transport speed or processing speed for the sheet of recording paper, and the amount of heat necessary for fixing the toner image onto the sheet of recording paper cannot be transferred between the sheet of recording paper and the rollers such that deficiencies occur in the fusing of the toner onto the sheet of recording paper. This is also because when the transport speed or processing speed for the sheet of recording paper is increased, the distance of separation between the sheets of recording paper becomes shorter, such that the time in which a sheet of recording paper is present in the nip region between the hot roller and the pressure roller becomes longer, thereby shortening the time in which the hot roller and the pressure roller are in direct contact, such that the amount of heat conducted from the hot roller to the pressure roller is reduced, thereby lowering the surface temperature of the pressure roller, and the amount of heat conducted to the sheets of recording paper passing through the nip region is reduced, which causes deficiencies in the fusing of the toner onto the sheet of recording paper. As a result, reductions in print quality are incurred.

For this reason, in JP 2004-198659A for example, an endless heating belt is brought into contact with the fixing roller and set so as to widen the contact surface area therebetween, thus making it possible to supply a sufficient amount of heat from the heating belt to the fixing roller.

Also, in JP 2004-85601A, external hot rollers are provided to contact each of the fixing rollers respectively and the amount of heat produced by each of the external hot rollers is controlled to achieve control over the heating of the surface of each of the fixing rollers by the respective external hot rollers, thereby maintaining the surface temperature of each of the fixing rollers.

However, in cases where the surface temperature of the fixing rollers is controlled by bringing a heating belt or an external hot roller into contact with the fixing rollers as in the above-mentioned JP 2004-198659A and JP 2004-85601A, when the surface temperature of the fixing rollers drops along with increases in the transport speed or processing speed for the sheet of recording paper as described above, the temperature of the heat source of the heating belt or the external hot roller or the like must be raised quickly to suppress drops in the surface temperature of the fixing rollers, and this increases the load on the heat source itself and the control circuits for the heat source.

Furthermore, since the contact surface area between the heating belt or the external hot roller and the fixing roller is kept constant, the heat of the heating belt or external hot roller will not always be conducted quickly to the fixing rollers even when the temperature of the heating belt or external hot roller is raised, which makes it difficult to control the surface temperature of the fixing rollers. For this reason, it is conceivable to widen the contact surface area between the heating belt or the external hot roller and the fixing roller to improve the thermal conduction between these, but doing this involves permanently increasing the resistance against the rotation of the fixing rollers, which increases the load on the rotational mechanism or the like of the fixing rollers.

SUMMARY OF THE INVENTION

An object of the present invention is to provide a fixing apparatus by which it is possible to always appropriately control the surface temperature of the fixing rollers without applying a large load on the heat source or the control circuits thereof or on the rotational mechanism or the like of the fixing rollers.

A fixing apparatus according to the present invention is provided with a plurality of fixing rollers that sandwich therebetween and transport a sheet of recording paper while applying pressure and heat to the sheet of recording paper, an external heating member that contacts at least one of the fixing rollers and heats the contacted fixing roller, and a control portion (control means) that causes displacement of the external heating member and varies in a stepwise manner a surface area or a length of a contact region between the external heating member and the fixing roller that is in contact with the external heating member.

The control portion may cause displacement of the external heating member in response to a processing speed for a sheet of recording paper and vary in a stepwise manner the surface area or the length of the contact region between the external heating member and the fixing roller that is in contact with the external heating member.

Or a fixing apparatus according to the present invention may be provided with a plurality of fixing rollers that sandwich therebetween and transport a sheet of recording paper while applying pressure and heat to the sheet of recording paper, an external heating member that contacts at least one of the fixing rollers and heats the contacted fixing roller, and a control portion that causes displacement of the external heating member to vary in a stepwise manner a surface area or a length of a contact region between the external heating member and the fixing roller that is in contact with the external heating member, and controls a temperature of the external heating member.

The control portion may cause displacement of the external heating member in response to a fixing apparatus processing speed, vary in a stepwise manner a surface area or a length of a contact region between the external heating member and the fixing roller that is in contact with the external heating member, and control the temperature of the external heating member.

Furthermore, the control portion may cause displacement of the external heating member, vary in a stepwise manner the surface area or the length of the contact region between the external heating member and the fixing roller that is in contact with the external heating member, and the temperature of the external heating member is caused to rise higher for increases in the surface area or the length of the contact region.

Further still, the external heating member may be provided with an endless belt, and a plurality of tension-providing rollers on which the endless belt spans in a tensioned state, and the endless belt may contact at least one of the fixing rollers.

Furthermore, a heating means may be provided for the tension-providing roller that is on an upstream side from a contact region between the endless belt and the fixing roller in a rotational direction of the fixing roller that contacts the external heating member.

Further still, a cam mechanism that causes displacement of at least one of the tension-providing rollers may be provided, and the control portion may perform drive control on the cam mechanism to cause displacement of at least one of the tension-providing rollers, and vary in a stepwise manner a surface area or a length of a contact region between the endless belt and the fixing roller that is in contact with the external heating member.

Furthermore, the cam mechanism may cause displacement of the tension-providing roller that is on a downstream side from a contact region between the endless belt and the fixing roller in a rotational direction of the fixing roller that contacts the external heating member.

Further still, the control portion may switch a setting of the external heating member to a first displacement position, a second displacement position, and a third displacement position in response to a standby mode, a color mode, and a monochrome mode of the fixing apparatus.

Furthermore, the surface area or the length of the contact region between the external heating member, which has been set to the first displacement position in response to the standby mode, and the fixing roller that is in contact with the external heating member may be zero.

Further still, the surface area or the length of the contact region between the external heating member, which has been set to the second displacement position in response to the color mode, and the fixing roller that is in contact with the external heating member may be less than the surface area or the length of the contact region between the external heating member, which has been set to the third displacement position in response to the monochrome mode, and the fixing roller.

Furthermore, the processing speed for a sheet of recording paper in the color mode may be slower than the processing speed for a sheet of recording paper in the monochrome mode.

Further still, the control portion may perform fine adjustments of a position of the external heating member in a state in which the external heating member has been set to the second displacement position or the third displacement position.

Furthermore, the control portion may perform fine adjustments of the position of the external heating member in response to a surface temperature of the fixing rollers.

Further still, the surface temperature of the fixing rollers may be detected by a temperature detection means provided on a downstream side from the contact region between the external heating member and the fixing roller in a rotational direction of the fixing roller that contacts the external heating member.

With the fixing apparatus of the present invention, the external heating member is brought into contact with at least one of the fixing rollers and varies in a stepwise manner a surface area or a length of a contact region between the external heating member and the fixing roller, and therefore the amount of heat that is conducted from the external heating member to the fixing roller can be adjusted, and the surface temperature of the fixing roller can be adjusted without applying a large load on the heat source or its control circuits. Furthermore, the load on the rotational mechanism of the fixing roller is made smaller when the surface area or length of the contact region between the external heating member and the fixing roller is reduced.

Furthermore, when varying in a stepwise manner the surface area or length of the contact region between the external heating member and the fixing roller in response to the processing speed for a sheet of recording paper, the amount of heat to be conducted to the sheets of recording paper tends to be insufficient when the processing speed for a sheet of recording paper is fast for example, and therefore the surface area or length of the contact region between the external heating member and the fixing roller is increased to increase the amount of heat conducted from the external heating member to the fixing roller, thereby supplementing the amount of heat that is conducted from the fixing roller to the sheets of recording paper.

Alternatively, if the temperature of the external heating member is controlled rather than only varying in a stepwise manner the surface area or length of the contact region between the external heating member and the fixing roller, then flexibility is increased for performing adjustments on the amount of heat conducted from the external heating member to the fixing roller, and the surface temperatures of the fixing rollers can be controlled reliably.

In this case, not only is the surface area or length of the contact region between the external heating member and the fixing roller varied in a stepwise manner in response to the processing speed for the sheet of recording paper, but the temperature of the external heating member is controlled. For example, the temperature of the external heating member is caused to rise for increases in the surface area or length of the contact region between the external heating member and the fixing roller, and the amount of heat conducted from the external heating member to the fixing roller is increased, and the amount of heat conducted from the fixing rollers to the sheets of recording paper is sufficiently supplemented.

Furthermore, in a case where the external heating member involves an endless belt spanning in a tensioned state between a plurality of tension-providing rollers, when a heating means is provided to a tension-providing roller that is on an upstream side from the contact region between the endless belt and the fixing roller, the heat of this tension-providing roller can be conducted quickly and with low loss through the endless belt to the fixing roller on the downstream side.

Further still, it is also possible to provide a cam mechanism that causes displacement of at least one of the tension-providing rollers so as to cause displacement of at least one of the tension-providing rollers, thereby varying in a stepwise manner the surface area or length of the contact region between the endless belt and the fixing roller.

Furthermore, no processing of the sheets of recording paper is carried out in standby mode and the processing speed for the sheet of recording paper is slow in color mode while the processing speed for the sheet of recording paper is fast in monochrome mode, and therefore it is preferable to switch the setting of the external heating member to a first displacement position, a second displacement position, and a third displacement position in response to these modes and vary in a stepwise manner the surface area or length of the contact region between the external heating member and the fixing roller.

No processing of the sheets of recording paper is carried out in standby mode, and therefore it is preferable to set the surface area or length of the contact region between the external heating member and the fixing roller to zero, that is, it is preferable that the external heating member is caused to move apart from the fixing roller.

Furthermore, the processing speed for the sheet of recording paper is slower in color mode than in monochrome mode, and therefore it is preferable to set the surface area or length of the contact region between the external heating member and the fixing roller lower in color mode than the surface area or length of the contact region in monochrome mode.

Further still, if fine adjustments of the position of the external heating member are made to achieve fine adjustments of the surface area or length of the contact region between the external heating member and the fixing roller, then it becomes possible to more accurately control the surface temperatures of the fixing rollers. In this case, it is preferable that fine adjustments of the position of the external heating member are performed in response to the surface temperatures of the fixing rollers.

Furthermore, if the surface temperature of the fixing roller is detected by a temperature detection means provided on a downstream side from the contact region between the external heating member and the fixing roller in the rotational direction of the fixing roller, then the surface temperature of the fixing roller can be detected immediately after being heated at the contact region and it becomes possible to accurately control the surface temperature of the fixing rollers.

DESCRIPTION OF THE PREFERRED EMBODIMENTS

Hereinafter, an embodiment of the present invention is described in detail with reference to the accompanying drawings.

Figure 1:
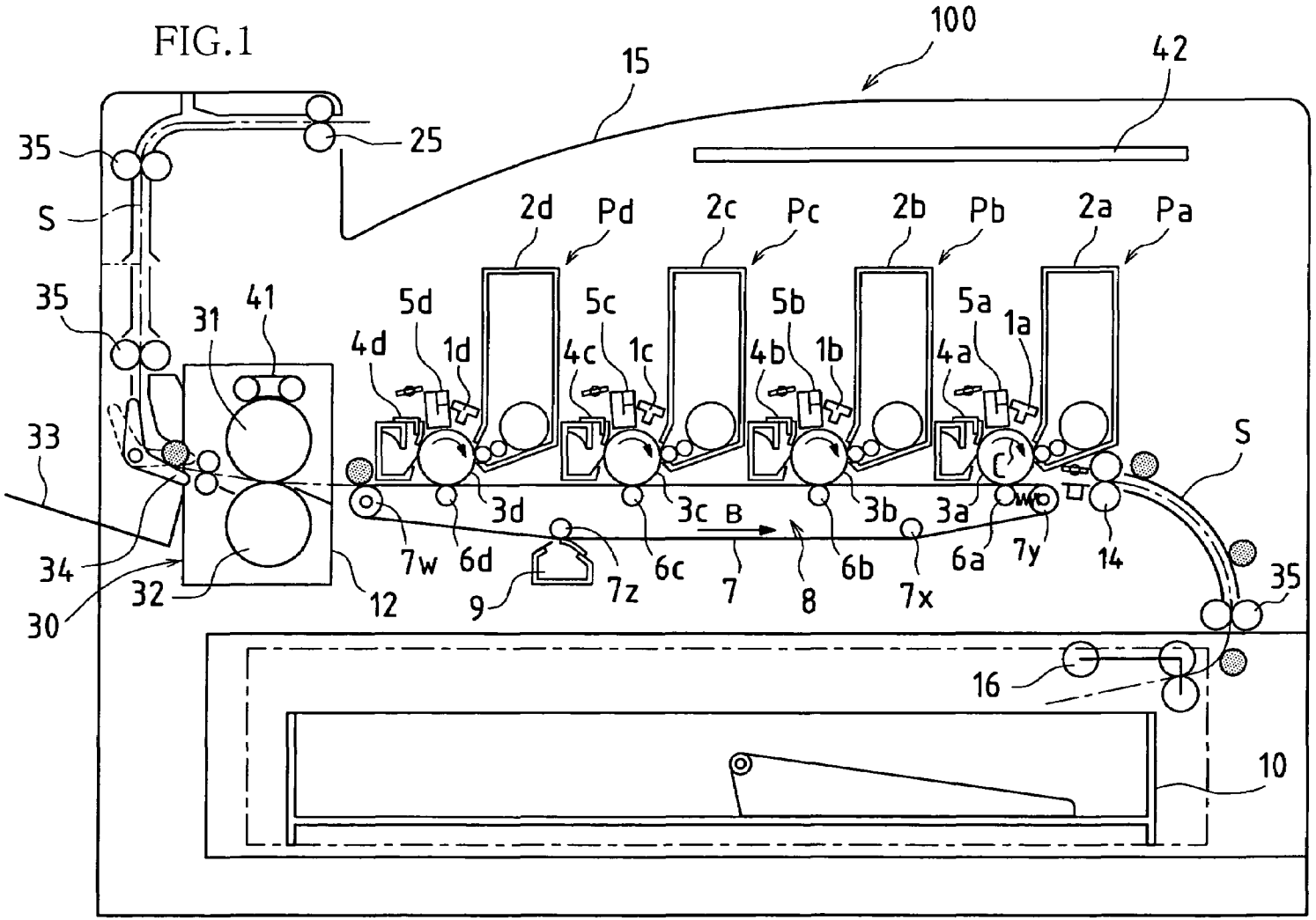
FIG. 1 is a cross-sectional view that schematically illustrates an image forming apparatus viewed laterally in which one embodiment of a fixing apparatus according to the present invention has been applied.

FIG. 1 is a cross-sectional view that schematically illustrates an image forming apparatus 100 viewed laterally in which one embodiment of a fixing apparatus according to the present invention has been applied. The image forming apparatus 100 receives image data that has been transmitted in from the outside and forms on a sheet of recording paper a color or a monochrome image indicated by that image data.

In the image forming apparatus 100, color image data is handled by being indicated as an image made up of black (K), cyan (C), magenta (M), and yellow (Y) colors, and for images made up of other colors, the image data is first subjected to a process in which the other colors are converted to black, cyan, magenta, and yellow, then the image data is used.

The image forming apparatus 100 is provided with components such as image forming stations Pa to Pd, a transfer/transport belt unit 8, a fixing apparatus 30, a paper transport path S, a paper feed tray 10, and discharge trays 15 and 33.

The transfer/transport belt unit 8 is arranged in a substantially central area inside the image forming apparatus 100, and an endless transfer/transport belt 7 is arranged in a looped tensioned state having its upper surface held substantially horizontal by a drive roller 7*w*, a tension roller 7*y*, and idler rollers 7*x* and 7*z*. The transfer/transport belt 7 is a film having a thickness in a range of 100 μm to 150 μm formed as an endless shape. The transfer/transport belt 7 is caused to rotate in a direction of arrow B by rotation of the drive roller 7*w* and the sheets of recording paper are electrostatically held on the upper surface of the looped shape thereof and transported. Furthermore, a lower surface of the looped shape of the transfer/transport belt 7 is cleaned by a cleaner 9. This is for removing toner that has adhered due to contact with the photosensitive drums 3*a* to 3*d* and preventing soiling on the rear surface of the sheets of recording paper.

The image forming stations Pa to Pd are arranged in a row along the upper surface of the looped shape of the transfer/transport belt 7. The image forming stations Pa to Pd all have the same structure and carry out electrophotographic image forming based on image data of the colors black (K), cyan (C), magenta (M), and yellow (Y).

As an example, around the periphery of the photosensitive drum 3*a* of the image forming station Pa are a charging unit 5*a*, an exposing unit 1*a*, a development unit 2*a*, a transfer roller 6*a*, and a cleaner unit 4*a*, which are arranged in order around the rotational direction of the photosensitive drum 3*a*.

The photosensitive drum 3*a* has a photosensitive layer that produces a photoconductive effect on a circumferential surface thereof and is rotationally driven in a direction shown by the arrow C. The charging unit 5*a* uniformly charges the surface of the photosensitive drum 3*a* to a predetermined electric potential using a direct contact roller form or brush form method, or a charging method involving corona discharge. The exposing unit 1*a* is a writing head in which light-emitting elements such as ELs or LEDs are arranged in an array in the rotating shaft direction (main scanning direction) of the photosensitive drum 3*a*, or a laser scanning unit (LSU) in which a laser beam irradiated from a semiconductor laser is deflected to the main scanning direction by a rotating polygon mirror, and exposes the surface of the photosensitive drum 3*a* using light modulated based on the image data for black. The electrostatic latent image is formed on the surface of the photosensitive drum 3*a* by this exposure.

The development unit 2*a* supplies black toner to the surface of the photosensitive drum 3*a* where the electrostatic latent image is formed and the electrostatic latent image is developed into a black toner image.

The transfer roller 6*a* is in opposition to the photosensitive drum 3*a* with interposition of the transfer/transport belt 7 and is applied with a high voltage of an inverse polarity to the charged polarity of the toner. For example, the transfer roller 6*a* is a component whereby a metal roller surface such as stainless steel of an 8 to 10 mm diameter is covered by a conductive elastic material having a material such as EPDM or foam urethane, and applies a uniform high voltage to the sheet of recording paper that is electrostatically held on the transfer/transport belt 7, thereby causing the toner image carried on the surface of the photosensitive drum 3*a* to transfer to the surface of the sheet of recording paper. The transfer roller 6*a* can be configured in a brush form.

The cleaner unit 4*a* recovers toner and paper dust and the like that is residual on the surface of the photosensitive drum 3*a*, which has passed a position opposing the transfer roller 6*a*.

The other image forming stations Pb to Pd carry out image forming based on image data of the colors cyan, magenta, and yellow in the same manner as the image forming station Pa. That is, image data of the colors cyan, magenta, and yellow is given to the exposing units 1*b* to 1*d*, the surfaces of the photosensitive drums 3*b* to 3*d* are exposed by respective lights that are modulated based on the image data of the colors, the electrostatic latent image on each of the surfaces of the photosensitive drums 3*b* to 3*d* is developed by toner of the colors cyan, magenta, and yellow of the development units 2*b* to 2*d*, and the toner images of the colors cyan, magenta, and yellow on the surfaces of the photosensitive drums 3*b* to 3*d* are successively transferred onto the sheet of recording paper on the transfer/transport belt 7 by the transfer rollers 6*b* to 6*d*.

The paper feed tray 10 accommodates multiple sheets of recording paper and is detachably loaded at the bottom of the image forming apparatus 100. Furthermore, the paper transport path S is formed inside the image forming apparatus 100. The paper transport path S leads from the paper feed tray 10 to the fixing apparatus 30 via the upper surface of the looped shape of the transfer/transport belt 7, then further passes through the fixing apparatus 30 to reach the discharge tray 33 loaded on a lateral surface of the image forming apparatus 100 or to reach the discharge tray 15 at an upper portion of the image forming apparatus 100. Arranged on the paper transport path S are components such as a pickup roller 16, transport rollers 35, PS rollers 14, a transport direction switching guide 34, and discharge rollers 25.

The discharge tray 33 stacks and accommodates the sheets of recording paper on which image forming is complete in a face-up manner where the image formed side faces upward. The discharge tray 15 stacks and accommodates the sheets of recording paper on which image forming is complete in a face-down manner where the image formed side faces downward. The transport direction switching guide 34 is rotated back and forth to enable selective switching of the discharge position of the sheets of recording paper to the discharge tray 33 or the discharge tray 15.

The transport rollers 35 are small-size rollers for facilitating and assisting the transport of the sheets of recording paper and a plurality of pairs are provided along the paper transport path S. The pickup roller 16 is provided in opposition to an uppermost surface of the sheets of recording paper accommodated in the paper feed tray 10 and takes out the sheets of recording paper sheet by sheet from the paper feed tray 10 and guides them to the paper transport path S. The PS rollers 14 temporarily stop each of the sheets of recording paper taken out from the paper feed tray 10 at an upstream side of the transfer/transport belt 7, after which they feed the sheet of recording paper to the transfer/transport belt 7 with a timing synchronized to the rotation of the photosensitive drums 3*a* to 3*d*.

In more detail, the PS rollers 14 temporarily stop their rotation with the timing of the feeding of the sheet of recording paper from the paper feed tray 10, then commence their rotation with a timing such that a leading edge of the sheet of recording paper at the transfer positions between each of the photosensitive drums 3*a* to 3*d* and each of the transfer rollers 6*a* to 6*d* corresponds to a leading edge of the toner images on the surface of each of the photosensitive drums 3*a* to 3*d*. In this way, the toner images of each of the colors black, cyan, magenta, and yellow on the surfaces of the photosensitive drums 3*a* to 3*d* are caused to become superimposed on a single sheet of recording paper without deviation.

The fixing apparatus 30 is provided with a set of a hot roller 31 and a pressure roller 32. Each of the rollers 31 and 32 is controlled so that its surface temperature is a prescribed fixing temperature capable of fusing toner, and these are pressed against each other with a predetermined pressing force and rotationally driven in one direction. The sheet of recording paper onto which toner images have been transferred is transported so as to pass through a nip region between the rollers 31 and 32, and is subjected to heat and pressure at this nip region. In this way, the toner images on the sheet of recording paper are fused and firmly fixed. The toner images of the colors black, cyan, magenta, and yellow that have been transferred onto a single sheet of recording paper become a color image due to a subtractive mixture of color.

When forming full color images in this manner, image forming is carried out in all of the four image forming stations Pa to Pd.

Monochrome images can also be formed. When forming a monochrome image, among the four image forming stations Pa to Pd, image forming is carried out in only the image forming station corresponding to the color of the image to be formed. The transport procedure for the sheets of recording paper and the fixing of the image onto the sheets of recording paper by the fixing apparatus 30 is the same as for color images.

In this regard, in this type of the image forming apparatus 100 the print processing speed is increased more for monochrome print processing than for color print processing so as to improve the usefulness. For example, when using standard A4 sheets of recording paper, the transport speed for the sheets of recording paper during color print processing is set to 41 sheets/minute (a processing speed of 225 mm/sec) and the transport speed for the sheets of recording paper during monochrome print processing is set to 70 sheets/minute (a processing speed of 350 mm/sec), thereby increasing the speed of monochrome print processing.

However, when the transport speed or processing speed for the sheet of recording paper is increased in the fixing apparatus 30, an amount of heat to be applied to the sheets of recording paper that pass through the nip region between the hot roller 31 and the pressure roller 32 tends to be insufficient, and also the surface temperatures of the rollers 31 and 32 tend to drop since the heat of the rollers 31 and 32 is taken away by the sheets of recording paper due to the increased number of sheets of recording paper processed, and if this is ignored, deficiencies occur in the fixing of the toner image to the sheets of recording paper.

Although heaters are provided internally in both of the rollers 31 and 32 of the fixing apparatus 30 to heat the rollers 31 and 32, with these heaters alone it is difficult to suppress drops in the surface temperature of the rollers 31 and 32 and to achieve accurate control of the surface temperature.

Consequently, the fixing apparatus 30 of the present embodiment is provided with an external heating unit 41 to heat the hot roller 31 from the outside thereof, and the hot roller 31 is directly heated by the external heating unit 41, and due to thermal conduction between the rollers 31 and 32, the pressure roller 32 is also heated indirectly, which suppresses drops in the surface temperatures of the rollers 31 and 32 and maintains the surface temperatures of these to prescribed fixing temperatures.

Figure 2:
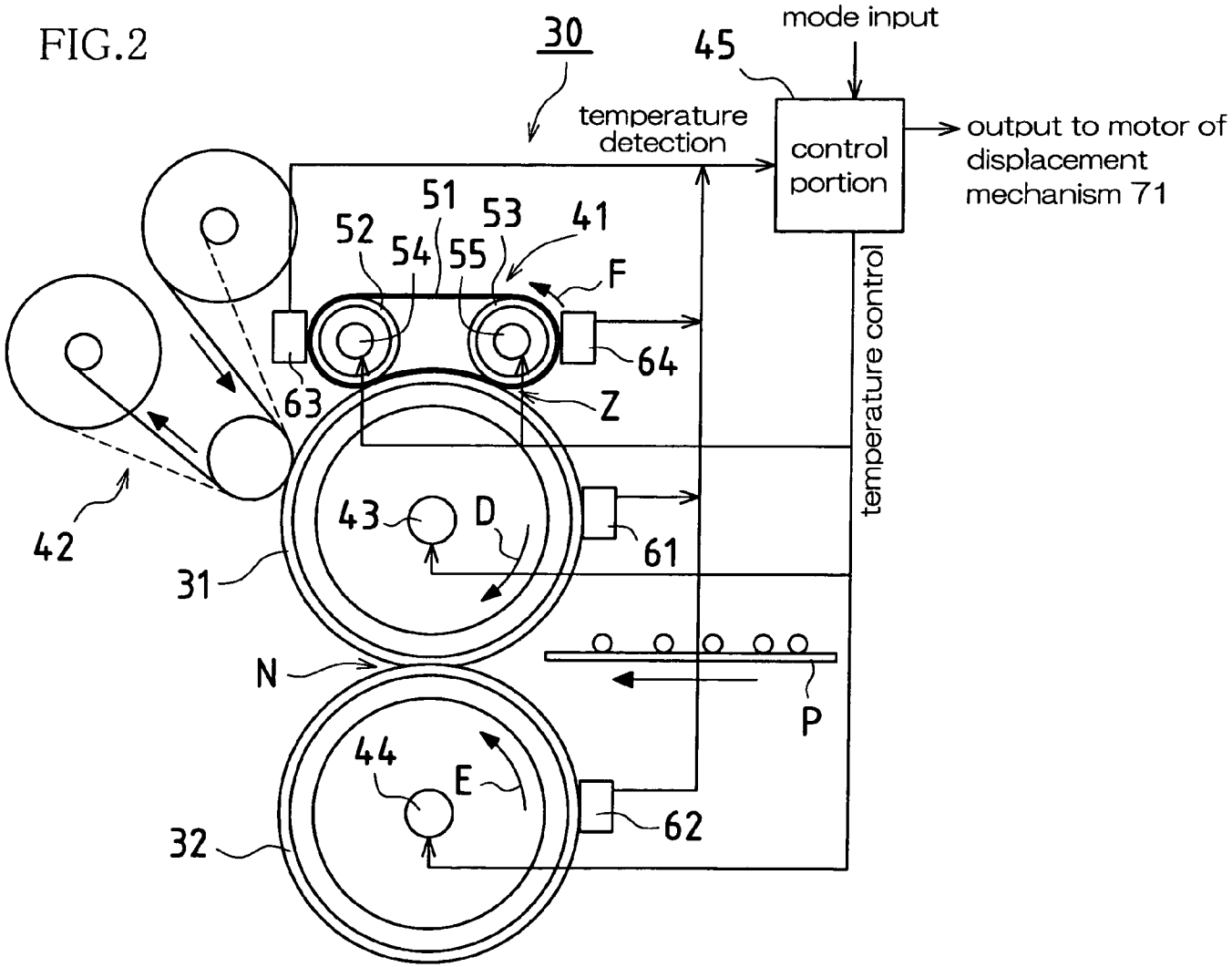
FIG. 2 is a cross-sectional view that schematically illustrates the fixing apparatus of the present embodiment as viewed laterally.

FIG. 2 is a cross-sectional view that schematically illustrates the fixing apparatus 30 as viewed laterally. The fixing apparatus 30 is provided with the hot roller 31, the pressure roller 32, the external heating unit 41 that heats the hot roller 31 from the outside, and a web cleaning apparatus 42 for removing toner that has adhered to the surface of the hot roller 31.

The rollers 31 and 32 press against each other with a predetermined pressing force (for example, 600 N) and a nip region N is formed between these. The length of the nip region N (the length along the rotation direction of the rollers 31 and 32) is set to 9 mm for example. The rollers 31 and 32 rotate while being heated to a prescribed fixing temperature (for example 180° C.) and the toner images on a sheet of recording paper P that passes through the nip region N are thermally fused.

The hot roller 31 is a roller having a three-layer construction and is provided with an elastic layer on an outer circumferential surface of its core and a mold release layer formed on an outer circumferential surface of the elastic layer. A metal such as iron, stainless steel, aluminum, or bronze for example, or an alloy of these or the like, is used for the core. Furthermore, a silicon rubber is used for the elastic layer, and a fluorocarbon resin such as PFA (a copolymer of tetrafluoroethylene and perfluoroalkyl vinyl ether) and PTFE (polytetrafluoroethylene) is used for the mold release layer.

A heat source heater lamp (halogen lamp) 43 for heating the roller 31 is provided inside the hot roller 31 (inside the core).

The pressure roller 32 is also a roller having a three-layer construction equivalent to the hot roller 31 and is constituted by a core of a metal such as iron, stainless steel, aluminum, or bronze or an alloy of any of these, an elastic layer of a silicon rubber or the like on a surface of the core, and further a mold release layer thereon of PFA or PTFE or the like on the elastic layer.

Furthermore, a heater lamp 44 for heating the roller 32 is also provided inside the pressure roller 32 (inside the core).

The heater lamps 43 and 44 of the rollers 31 and 32 are subjected to on-off control by a control portion 45, with infrared rays being radiated during ON times to heat the rollers 31 and 32 respectively. The rollers 31 and 32 are heated from the inside thereof and their surfaces are uniformly heated.

The external heating unit 41 is provided with an endless heating belt 51 and a pair of external hot rollers 52 and 53. The endless heating belt 51 spans in tensioned state between the external hot rollers 52 and 53.

The endless heating belt 51 is a belt having a two-layer construction in which a mold release layer constituted by a synthetic resin material having excellent heat resistance and releasability (a fluorocarbon resin such as PFA and PTFE for example) is formed on a surface of a hollow cylindrical base material constituted by a heat resistant resin such as polyimide or a metal material such as stainless steel or nickel. A coating of fluorocarbon resin or the like may be provided on an inner circumferential surface of the belt base material to reduce the skew force of the endless heating belt 51.

The external hot rollers 52 and 53 are hollow cylindrical metal core materials constituted by aluminum or a ferrous material or the like. A coating of fluorocarbon resin or the like may be provided on a surface of the metal core material to reduce the skew force of the endless heating belt 51.

Furthermore, heater lamps 54 and 55 are provided inside the external hot rollers 52 and 53 respectively to heat the rollers 52 and 53. The heater lamps 54 and 55 are subjected to on-off control by the control portion 45, with infrared rays being radiated during ON times to heat the rollers 52 and 53 respectively. The rollers 52 and 53 are heated from the inside thereof and their surfaces are uniformly heated. Then, thermal conduction is implemented from the surfaces of the rollers 52 and 53 to the endless heating belt 51 and the entire endless heating belt 51 is heated uniformly when the endless heating belt 51 rotates with the rollers 52 and 53.

Thermistors 61 and 62 are arranged respectively near the circumferential surfaces of the hot roller 31 and the pressure roller 32. The thermistors 61 and 62 detect the surface temperatures of the hot roller 31 and the pressure roller 32.

Also, thermistors 63 and 64 are arranged respectively in two locations near the circumferential surface of the endless heating belt 51 and in opposition to the external hot rollers 52 and 53 with interposition of the endless heating belt 51. The thermistors 63 and 64 detect the surface temperature of the endless heating belt 51 at two locations in opposition to the external hot rollers 52 and 53.

The control portion 45 receives as input the surface temperatures of the hot roller 31 and the pressure roller 32 detected by the thermistors 61 and 62 and the surface temperature of the endless heating belt 51 detected by the thermistors 63 and 64, then performs on-off control of the heater lamps 43 and 44 of the hot roller 31 and the pressure roller 32 and the heater lamps 54 and 55 of the external hot rollers 52 and 53 based on these detected surface temperatures so as to regulate the surface temperatures of the hot roller 31 and the pressure roller 32 and the surface temperature of the endless heating belt 51.

Here, the shaft of the hot roller 31 is rotationally driven by a motor and a power transmission structure or the like (not shown in drawings) and rotates in a direction indicated by arrow D. Due to being pressed against the hot roller 31, the pressure roller 32 is idly rotated in a direction indicated by arrow E. Furthermore, as is described later, the endless heating belt 51 of the external heating unit 41 can be brought into and out of contact with the hot roller 31, but when it is in contact with the hot roller 31, it is idly rotated in a direction indicated by arrow F. In this way, the hot roller 31, the pressure roller 32, and the endless heating belt 51 rotate in mutual synchronization.

Note however that when the endless heating belt 51 is apart from the hot roller 31, the endless heating belt 51 does not rotate.

For example, when the transport speed for the sheets of recording paper is set to 41 sheets/min (a processing speed of 225 mm/sec) during color print processing as mentioned earlier, the hot roller 31 is rotationally driven at a rotational speed coordinated to this transport speed, and the pressure roller 32 and the endless heating belt 51 are idly rotated by the rotation of the hot roller 31. Similarly, when the transport speed for the sheets of recording paper is set to 70 sheets/min (a processing speed of 350 mm/sec) during monochrome print processing, the hot roller 31 is rotationally driven at a rotational speed coordinated to this transport speed, and the pressure roller 32 and the endless heating belt 51 are idly rotated by the rotation of the hot roller 31.

On the other hand, the external heating unit 41 has a displacement mechanism for displacing the endless heating belt 51 with respect to the hot roller 31.

Figure 3A:
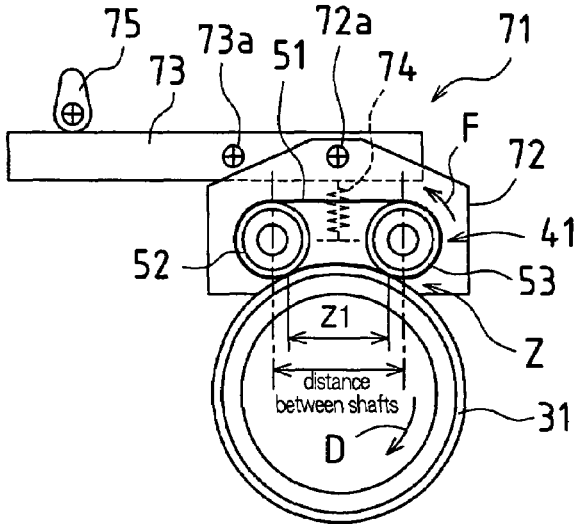
FIGS. 3(*a*) to 3(*c*) are lateral views showing a displacement mechanism in the fixing apparatus of FIG. 2 and illustrates operation thereof.
Figure 3B:
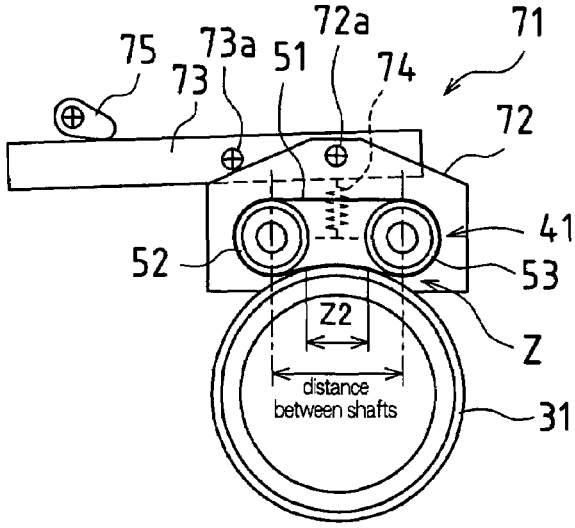
Figure 3C:
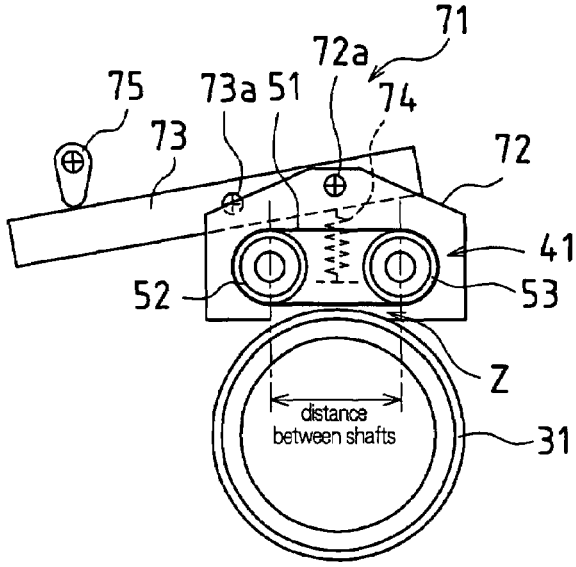
Figure 4:
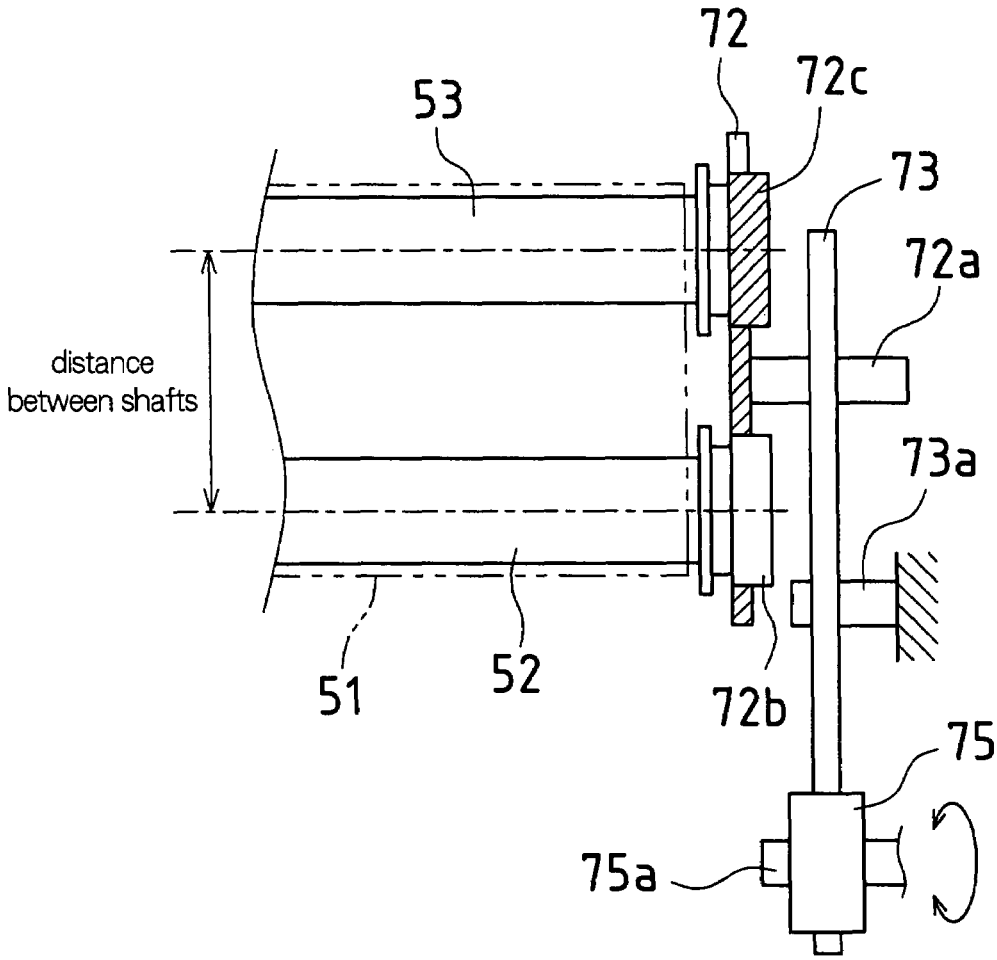
FIG. 4 is a top view illustrating the displacement mechanism of FIG. 3(*a*).

FIG. 3(*a*) and FIG. 4 are a lateral view and a top view that schematically illustrate the displacement mechanism for displacing the endless heating belt 51 with respect to the hot roller 31. It should be noted that in FIG. 4, only a half of one side of the displacement mechanism is shown.

A displacement mechanism 71 is provided with a pair of support plates 72 on which are arranged shaft bearings 72*b* and 72*c* of the external hot rollers 52 and 53, a pair of arms 73 that are rotatably supported with a center support shaft 73*a* thereof serving as the fulcrum, springs 74 that pull down on right side portions of the arms 73 respectively, and a pair of eccentric cams 75 that contact an upper left side area of the arms 73, and right side portions of the arms 73 are rotatably coupled to support shafts 72*a* of the support plates 72.

A shaft 75*a* of the eccentric cams 75 is rotationally driven by a motor and a power transmission structure or the like (not shown in drawings). The control portion 45 performs drive control for a motor that is the drive source for rotating the shaft 75*a* of the eccentric cams 75, thereby causing the eccentric cams 75 to rotate.

In the state shown in FIG. 3(*a*), the right side portions of the arms 73 are being pulled down by the springs 74 and the support plates 72 coupled to the right side portion of the arms 73 are moved downward, such that the endless heating belt 51 spanning in a tensioned state between the external hot rollers 52 and 53 is in contact and pushing on the circumferential surface of the hot roller 31. Furthermore, since the center support shaft 73*a* of the arms 73 is a fulcrum, the left side upper areas of the arms 73 are raised and in contact with the circumferential surface of the eccentric cams 75. At this time, the support plates 72 are moved lowest and a length (or surface area) of a heating contact region Z between the endless heating belt 51 and the hot roller 31 is a maximum z1.

When the eccentric cams 75 rotate as shown in FIG. 3(*b*), the left side upper areas of the arms 73 are pushed down by the circumferential surface of the eccentric cams 75 and the arms 73 rotate around the fulcrum of the center support shaft 73*a* such that the right side portions of the arms 73 resist the spring force of the springs 74 and rise, and the support plates 72 also rise such that the external hot rollers 52 and 53 are raised up and the length (or surface area) of the heating contact region Z between the endless heating belt 51 and the hot roller 31 is reduced to z2.

Further still, when the eccentric cams 75 rotate as shown in FIG. 3(*c*), the left side upper areas of the arms 73 are further pushed down by the circumferential surface of the eccentric cams 75 such that the support plates 72 rise higher and the external hot rollers 52 and 53 are raised up so that the endless heating belt 51 moves apart from the hot roller 31 and the surface area or length of the heating contact region Z between the endless heating belt 51 and the hot roller 31 becomes zero.

Figure 5A:
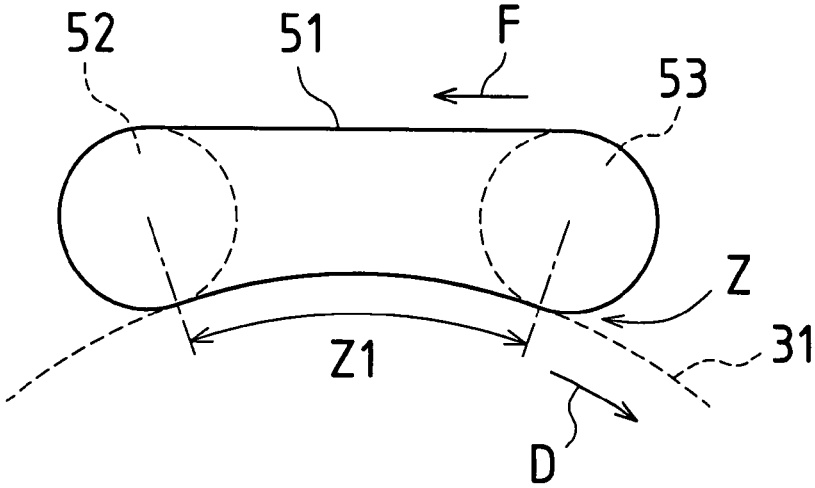
FIGS. 5(*a*) to 5(*c*) show an extraction of an endless heating belt and a hot roller of FIG. 3(*a*) to 3(*c*).
Figure 5B:
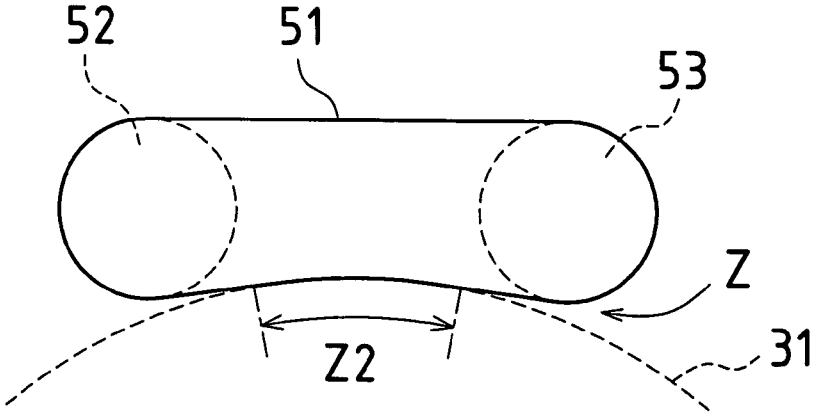
Figure 5C:
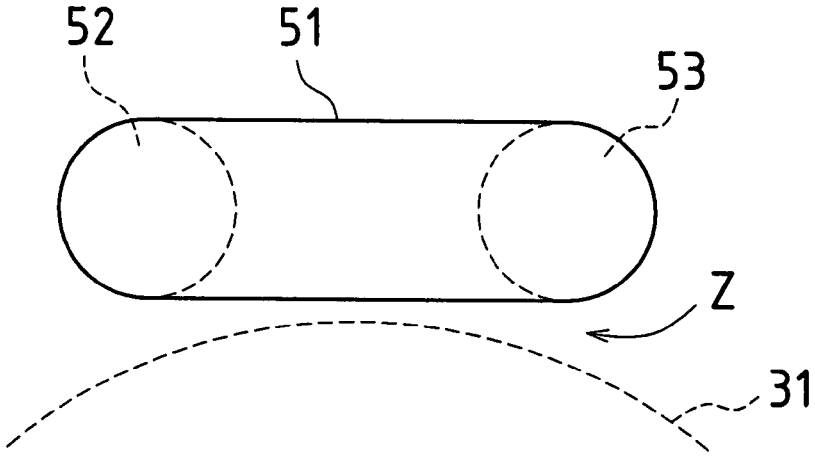

FIG. 5(*a*) to FIG. 5(*c*) show an extraction of the endless heating belt 51 and the hot roller 31 of FIG. 3(*a*) to FIG. 3(*c*).

As shown in FIG. 3(*a*) and FIG. 5(*a*), in a state where the surface area or length of the heating contact region Z between the endless heating belt 51 and the hot roller 31 has become the maximum z1, thermal conduction between the hot roller 31 and the endless heating belt 51 is carried out excellently.

Furthermore, as shown in FIG. 3(*b*) and FIG. 5(*b*), in a state where the surface area or length of the heating contact region Z between the endless heating belt 51 and the hot roller 31 has reduced to z2, thermal conduction between the hot roller 31 and the endless heating belt 51 is maintained but the rotational resistance to the hot roller 31 received from the endless heating belt 51 becomes smaller, and the hot roller 31, the pressure roller 32, and endless heating belt 51 can be made to rotate easily.

Further still, as shown in FIG. 3(*c*) and FIG. 5(*c*), in a state where the endless heating belt 51 has become apart from the hot roller 31, although thermal conduction between the hot roller 31 and the endless heating belt 51 becomes impossible, the rotational resistance to the hot roller 31 received from the endless heating belt 51 is eliminated.

Here, as mentioned earlier, the control portion 45 performs on-off control for the heater lamps 43 and 44 of the hot roller 31 and the pressure roller 32 and the heater lamps 54 and 55 of the external hot rollers 52 and 53 based on the surface temperatures of the hot roller 31 and the pressure roller 32 and the surface temperature of the endless heating belt 51 detected by the thermistors 61 to 64, but rather than only this on-off control, simultaneous to this it also performs drive control of the displacement mechanism 71 in response to a standby mode, a monochrome mode, and a color mode so as to vary the surface area or length of the heating contact region Z between the endless heating belt 51 and the hot roller 31 and regulate an extent of thermal conduction between the hot roller 31 and the endless heating belt 51.

For example, in the standby mode where print processing is not carried out, the control portion 45 performs drive control on the motor that is the drive source of the displacement mechanism 71 to rotate the eccentric cams 75 and achieve positioning as shown in FIG. 3(*c*), so that the endless heating belt 51 is made to move apart from the hot roller 31. In this way, the rotational resistance to the hot roller 31 received from the endless heating belt 51 is eliminated and it becomes possible to cause the hot roller 31 and the pressure roller 32 to rotate easily. Furthermore, thermal conduction between the hot roller 31 and the endless heating belt 51 is eliminated.

In this state, the control portion 45 performs drive control on the motor that is the drive source of the hot roller 31 and rotationally drives the hot roller 31 and causes the pressure roller 32 to be idly rotated at a prescribed rotational speed for standby Furthermore, while monitoring the surface temperatures of the hot roller 31 and the pressure roller 32 detected by the thermistors 61 and 62, the control portion 45 performs on-off control on the heater lamps 43 and 44 of the rollers 31 and 32 so that the surface temperatures of the rollers 31 and 32 are made to rise to the prescribed fixing temperature of 180° C., and thereafter maintains these surface temperatures. Further still, while monitoring the surface temperature of the endless heating belt 51 detected by the thermistors 63 and 64, the control portion 45 performs on-off control on the heater lamps 54 and 55 of the external hot rollers 52 and 53 so that the surface temperature of the endless heating belt 51 is made to rise to a fixed temperature (for example, 180° C. as for the hot roller 31 and the pressure roller 32), and thereafter maintains this surface temperature.

Consequently, in standby mode, in a state where the endless heating belt 51 is made to be apart from the hot roller 31 as shown in FIG. 3(*c*), the surface temperatures of the hot roller 31 and the pressure roller 32 are maintained at the prescribed fixing temperature of 180° C. and the surface temperature of the endless heating belt 51 is maintained at a fixed temperature. In this state, the rotational resistance to the hot roller 31 received from the endless heating belt 51 is eliminated and therefore the load on the rotational mechanism becomes lighter.

Furthermore, in the color mode where color print processing is carried out, the control portion 45 performs drive control on the motor that is the drive source of the displacement mechanism 71 to rotate the eccentric cams 75 and achieve positioning as shown in FIG. 3(*b*), so that the endless heating belt 51 is caused to contact the hot roller 31, and the length (or surface area) of the heating contact region Z between the endless heating belt 51 and the hot roller 31 is set to z2. In this way, it becomes possible for the endless heating belt 51 to be idly rotated by the hot roller 31 and thermal conduction between the hot roller 31 and the endless heating belt 51 becomes possible.

In this state, the hot roller 31 is rotationally driven at the prescribed rotational speed for color mode and the pressure roller 32 and the endless heating belt 51 are idly rotated. Since the transport speed for the sheets of recording paper is set to 41 sheets/min (a processing speed of 225 mm/sec) in color mode as mentioned earlier, the rotational speed of the hot roller 31 is set so that the sheets of recording paper pass between the hot roller 31 and the pressure roller 32 while maintaining this transport speed.

At this time, while monitoring the surface temperatures of the hot roller 31 and the pressure roller 32 detected by the thermistors 61 and 62, the control portion 45 performs on-off control on the heater lamps 43 and 44 of the rollers 31 and 32 so that the surface temperatures of the rollers 31 and 32 are regulated to the fixing temperature (for example, 180° C.). In particular, since the thermistor 61 is arranged on a downstream side from the heating contact region Z in the rotational direction of the hot roller 31, it is possible to detect the temperature of the circumferential surface portions of the hot roller 31 immediately after being heated by the endless heating belt 51, which is useful in achieving accurate control of the surface temperature of the hot roller 31.

Further still, while monitoring the surface temperature of the endless heating belt 51 detected by the thermistors 63 and 64, the control portion 45 performs on-off control on the heater lamps 54 and 55 of the external hot rollers 52 and 53 so that the surface temperature of the endless heating belt 51 is controlled to a prescribed temperature range for color mode (for example, 200° C. to 210° C.). The prescribed temperature range for color mode is set higher than the fixing temperature of 180° C.

For example, when the detected surface temperatures of the hot roller 31 and the pressure roller 32 drop below the fixing temperature of 180° C., the control portion 45 raises the surface temperature of the endless heating belt 51 within a range of 200° C. to 210° C. such that the surface temperatures of the hot roller 31 and the pressure roller 32 are caused to rise and return to the fixing temperature of 180° C. Or, when the detected surface temperatures of the hot roller 31 and the pressure roller 32 rise higher than the fixing temperature of 180° C., the control portion 45 lowers the surface temperature of the endless heating belt 51 within a range of 200° C. to 210° C. such that the surface temperatures of the hot roller 31 and the pressure roller 32 are caused to drop and return to the fixing temperature of 180° C.

Furthermore, the control portion 45 causes the eccentric cams 75 of the displacement mechanism 71 to rotate in response to the detected surface temperatures of the hot roller 31 and the pressure roller 32 such that the length (or surface area) of the heating contact region Z between the endless heating belt 51 and the hot roller 31 is finely adjusted to be slightly greater or less than z2.

For example, when the detected surface temperatures of the hot roller 31 and the pressure roller 32 drop below the fixing temperature of 180° C., the control portion 45 increases the length (or surface area) of the heating contact region Z between the endless heating belt 51 and the hot roller 31 to be slightly greater than z2, which improves the efficiency of thermal conduction between the endless heating belt 51 and the hot roller 31 so that it becomes easier for the surface temperatures of the hot roller 31 and the pressure roller 32 to rise. Furthermore, when the detected surface temperatures of the hot roller 31 and the pressure roller 32 rises above the fixing temperature of 180° C., the control portion 45 decreases the length (or surface area) of the heating contact region Z between the endless heating belt 51 and the hot roller 31 to be slightly less than z2, which lowers the efficiency of thermal conduction between the endless heating belt 51 and the hot roller 31 so that it becomes easier for the surface temperatures of the hot roller 31 and the pressure roller 32 to drop.

Accordingly, in color mode, the surface temperatures of the hot roller 31 and the pressure roller 32 are controlled using on-off control of the heater lamps 43 and 44 of the hot rollers 31 and 32, and at the same time as this the surface temperature of the endless heating belt 51 is regulated within a prescribed range of 200° C. to 210° C., which is higher than the fixing temperature of 180° C., and moreover, the length (or surface area) of the heating contact region Z between the endless heating belt 51 and the hot roller 31 is adjusted as shown in FIG. 3(*b*) to be slightly greater or less than z2. This maintains the surface temperatures of the hot roller 31 and the pressure roller 32 at the fixing temperature of 180° C.

In color mode, heat of the rollers 31 and 32 is taken away by the sheets of recording paper that pass through the nip region N between the hot roller 31 and the pressure roller 32 of the fixing apparatus 30. Accordingly, the surface temperature of the endless heating belt 51 is regulated within a prescribed range of 200° C. to 210° C., which is higher than the fixing temperature of 180° C., so that the supply of heat from the endless heating belt 51 to the hot roller 31 and the pressure roller 32 is carried out reliably.

Furthermore, the length (or surface area) of the heating contact region Z between the endless heating belt 51 and the hot roller 31 is regulated to be slightly greater or less than z2 so as to appropriately set the efficiency of thermal conduction between the endless heating belt 51 and the hot roller 31, which makes possible accurate direct supply of heat from the endless heating belt 51 to the hot roller 31 and also indirect supply of heat to the pressure roller 32 through the hot roller 31.

As a result, the surface temperatures of the hot roller 31 and the pressure roller 32 continue to be maintained at the fixing temperature of 180° C. and deficiencies are prevented from occurring in the fixing of the toner image to the sheets of recording paper.

Further still, in the monochrome mode where monochrome print processing is carried out, the control portion 45 performs drive control on the motor that is the drive source of the displacement mechanism 71 to rotate the eccentric cams 75 and achieve positioning as shown in FIG. 3(*a*), so that the length (or surface area) of the heating contact region Z between the endless heating belt 51 and the hot roller 31 is set to the maximum of z1. At this time, the efficiency of thermal conduction between the hot roller 31 and the endless heating belt 51 is greatest.

In this state, the hot roller 31 is rotationally driven at the prescribed rotational speed for monochrome mode and the pressure roller 32 and the endless heating belt 51 are idly rotated. Since the transport speed for the sheets of recording paper is set to 70 sheets/min (a processing speed of 350 mm/sec) in monochrome mode as mentioned earlier, the rotational speed of the hot roller 31 is set so that the sheets of recording paper pass between the hot roller 31 and the pressure roller 32 while maintaining this transport speed.

While monitoring the surface temperatures of the hot roller 31 and the pressure roller 32 detected by the thermistors 61 and 62, the control portion 45 performs on-off control on the heater lamps 43 and 44 of the rollers 31 and 32 so that the surface temperatures of the rollers 31 and 32 are maintained at the fixing temperature of 180° C. Further still, while monitoring the surface temperature of the endless heating belt 51 detected by the thermistors 63 and 64, the control portion 45 performs on-off control on the heater lamps 54 and 55 of the external hot rollers 52 and 53 so that the surface temperature of the endless heating belt 51 is controlled so as to raise the surface temperature in a prescribed temperature range for monochrome mode (for example, 210° C. to 220° C.). The prescribed temperature range for monochrome mode is set sufficiently higher than the fixing temperature of 180° C.

Furthermore, the control portion 45 causes the eccentric cams 75 of the displacement mechanism 71 to rotate in response to the detected surface, temperatures of the hot roller 31 and the pressure roller 32 such that the length (or surface area) of the heating contact region Z between the endless heating belt 51 and the hot roller 31 is finely adjusted to be slightly greater or less than z1 and the efficiency of thermal conduction between the endless heating belt 51 and the hot roller 31 is regulated.

Accordingly, in monochrome mode, the surface temperatures of the rollers 31 and 32 are controlled using on-off control of the heater lamps 43 and 44 of the hot roller 31 and the pressure roller 32, and at the same time the surface temperature of the endless heating belt 51 is regulated within a prescribed range of 210° C. to 220° C., which is sufficiently higher than the fixing temperature of 180° C., and moreover, the length (or surface area) of the heating contact region Z between the endless heating belt 51 and the hot roller 31 is adjusted as shown in FIG. 3(*a*) to be slightly greater or less than z1. This maintains the surface temperatures of the hot roller 31 and the pressure roller 32 at the fixing temperature of 180° C.

Since the print processing speed is increased in monochrome mode, there is a high number of sheets of recording paper per unit of time that pass through the nip region between the hot roller 31 and the pressure roller 32 and a greater amount of heat of the rollers 31 and 32 is taken away by the sheets of recording paper. Accordingly, the surface temperature of the endless heating belt 51 is regulated within a prescribed range of 210° C. to 220° C., which is sufficiently higher than the fixing temperature of 180° C., so that the supply of heat from the endless heating belt 51 to the hot roller 31 and the pressure roller 32 is carried out reliably.

Furthermore, the length (or surface area) of the heating contact region Z between the endless heating belt 51 and the hot roller 31 is adjusted to be slightly greater or less than z1 so as to achieve appropriate and high efficiency of thermal conduction between the endless heating belt 51 and the hot roller 31, which makes possible direct supply of a great amount of heat from the endless heating belt 51 to the hot roller 31 and also indirect supply of heat to the pressure roller 32 through the hot roller 31.

As a result, even in monochrome mode where the print processing speed is higher, the surface temperatures of the hot roller 31 and the pressure roller 32 continue to be maintained at the fixing temperature of 180° C. and deficiencies are prevented from occurring in the fixing of the toner image to the sheets of recording paper.

In this manner, in the fixing apparatus 30 of the present embodiment, in standby mode, the endless heating belt 51 is caused to move apart from the hot roller 31 such that the surface temperatures of the hot roller 31 and the pressure roller 32 are set to the fixing temperature of 180° C. while ensuring that rotational resistance from the endless heating belt 51 is not received by the hot roller 31. Furthermore, in color mode, the endless heating belt 51 is caused to contact the hot roller 31 to make possible thermal conduction between the endless heating belt 51 and the hot roller 31, and the surface temperature of the endless heating belt 51 is regulated within a prescribed range of 200° C. to 210° C., which is higher than the fixing temperature of 180° C., so that heat is supplied from the endless heating belt 51 to the hot roller 31 and the surface temperatures of the hot roller 31 and the pressure roller 32 are maintained at the fixing temperature of 180° C. Further still, in monochrome mode, since the number of sheets of recording paper to undergo print processing per unit of time is greater such that a greater amount of heat of the hot roller 31 and the pressure roller 32 is taken away by the sheets of recording paper, the length (or surface area) of the heating contact region Z between the endless heating belt 51 and the hot roller 31 is set to the maximum of z1, which increases the efficiency of thermal conduction between the endless heating belt 51 and the hot roller 31 so that the surface temperature of the endless heating belt 51 is regulated within a prescribed range of 210° C. to 220° C., which is sufficiently higher than the fixing temperature of 180° C., and the surface temperatures of the hot roller 31 and the pressure roller 32 are maintained at the fixing temperature of 180° C.

Figure 6A:
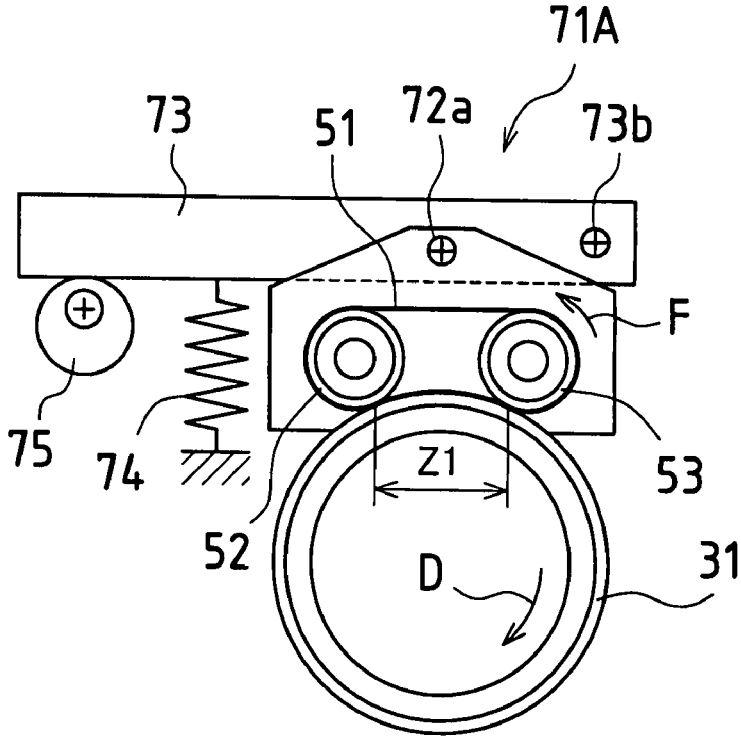
FIGS. 6(*a*) and 6(*b*) are side views showing a modified example of the displacement mechanism in the fixing apparatus of FIG. 2 and illustrates operation thereof.
Figure 6B:
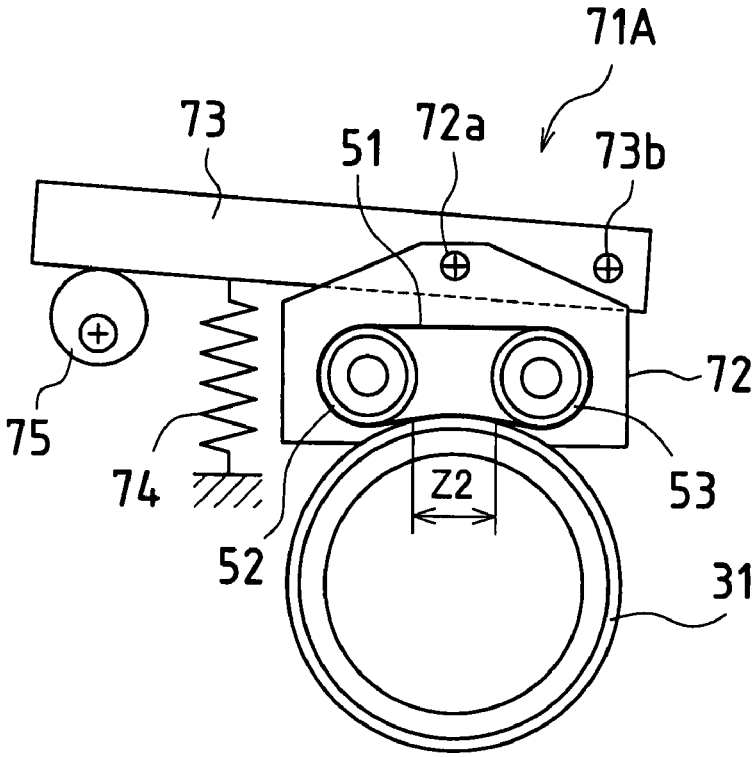
Figure 7:
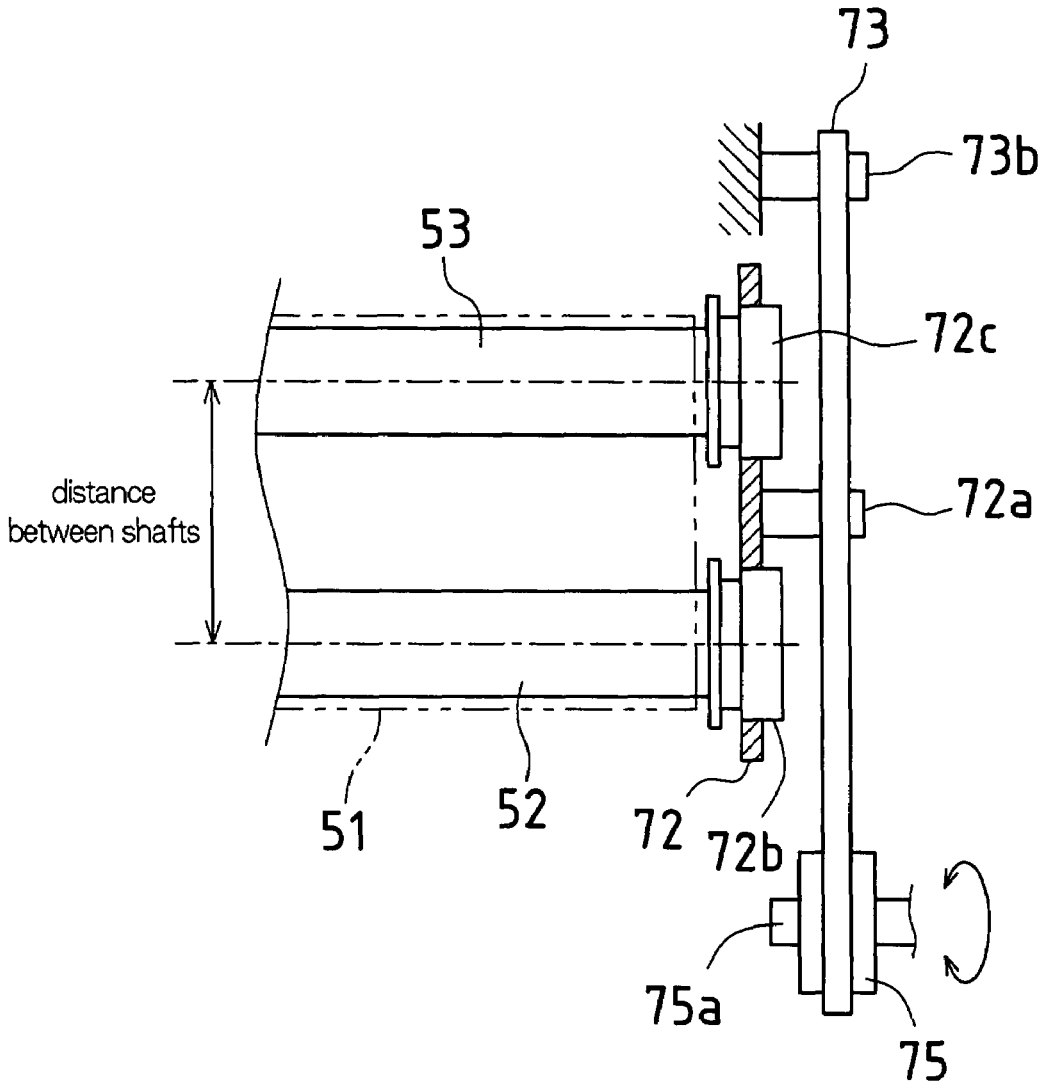
FIG. 7 is a top view illustrating the displacement mechanism of FIG. 6(*a*).

It should be noted that the present invention is not limited to the above-described embodiment, but includes other various variations. For example, a displacement mechanism 71A as shown in FIG. 6(*a*) and FIG. 7 can be used. Here, the arms 73 are rotatably supported on a support shaft 73*b* as a fulcrum near the right end of the arms 73, and the eccentric cams 75 are brought into contact with a left side lower area of the arms 73, and moreover the springs 74 are arranged between the support shaft 73*b* near the right end of the arms 73 and the eccentric cams 75 so that the left side portion of the arms 73 is pulled down by the springs 74.

With the displacement mechanism 71A of this configuration, the left side portions of the arms 73 are pulled down by the springs 74 as shown in FIG. 6(*a*) and the support plates 72 coupled to the arms 73 are moved downward, such that the endless heating belt 51 spanning in a tensioned state between the external hot rollers 52 and 53 pushes on the circumferential surface of the hot roller 31, and the left side lower area of the arms 73 is in contact with the circumferential surface of the eccentric cams 75. In this state, the support plates 72 are moved lowest and the length (or surface area) of the heating contact region Z between the endless heating belt 51 and the hot roller 31 is the maximum z1.

When the eccentric cams 75 are caused to rotate as shown in FIG. 6(*b*), the left side lower areas of the arms 73 are pushed up by the circumferential surface of the eccentric cams 75 and the arms 73 rotate around the fulcrum of the support shaft 73*b* such that a central area of the arms 73 resist the spring force of the springs 74 and rise, and the support plates 72 also rise such that the external hot rollers 52 and 53 are raised up and the length (or surface area) of the heating contact region Z between the endless heating belt 51 and the hot roller 31 is reduced to z2.

Figure 8A:
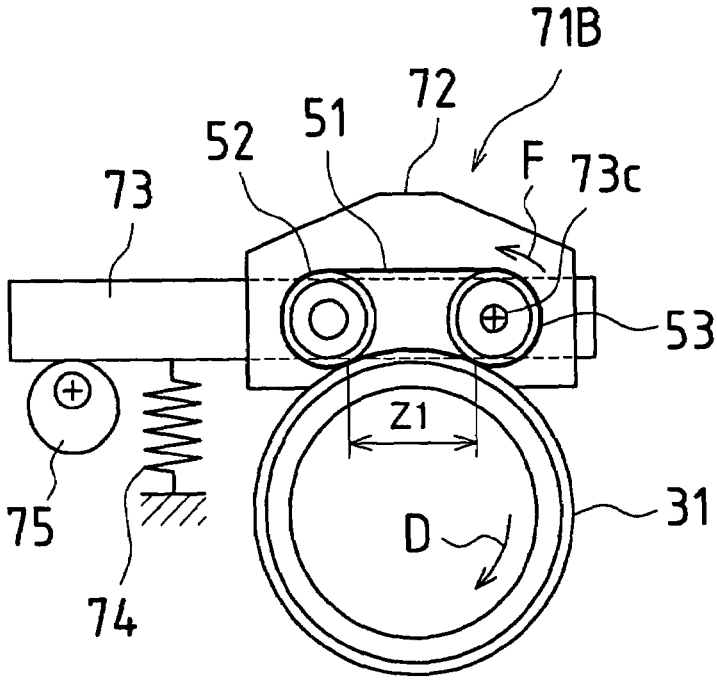
FIGS. 8(*a*) and 8(*b*) are side views showing another modified example of the displacement mechanism in the fixing apparatus of FIG. 2 and illustrates operation thereof.
Figure 8B:
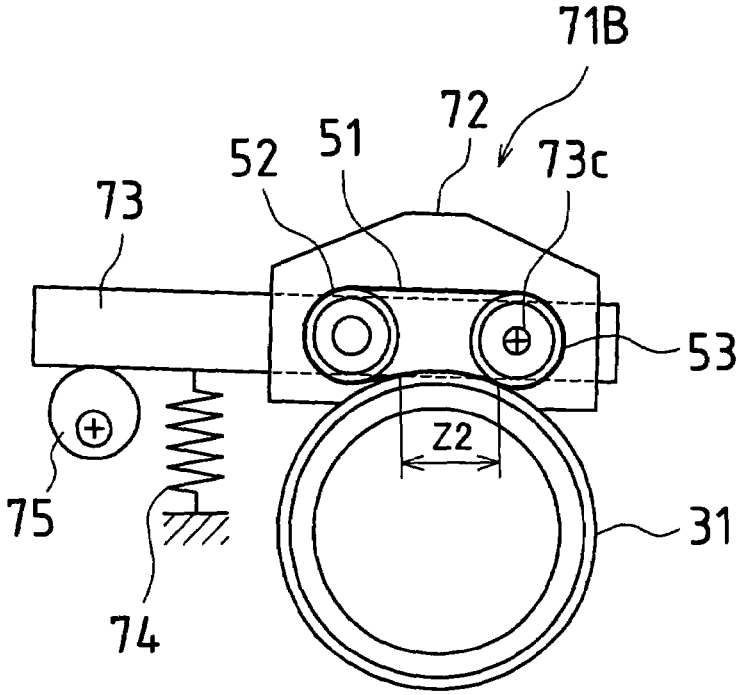

FIG. 8(*a*) shows another displacement mechanism. With a displacement mechanism 71B, a support shaft 73*c* of a right end portion of the arms 73 and a shaft of the right side external hot roller 53 are made to correspond. Furthermore, the eccentric cams 75 are brought into contact with the left side lower area of the arms 73 and moreover the springs 74 are arranged between the support shaft 73*c* of the right end portion of the arms 73 and the eccentric cams 75 so that the left side portions of the arms 73 is pulled down by the springs 74.

With the displacement mechanism 71B of this configuration, the left side portions of the arms 73 are pulled down by the springs 74 as shown in FIG. 8(*a*) and the left side external hot roller 52 is moved downward such that the endless heating belt 51 pushes on the circumferential surface of the hot roller 31, and the left side lower area of the arms 73 is in contact with the circumferential surface of the eccentric cams 75. In this state, the support plates 72 are moved lowest and the length (or surface area) of the heating contact region Z between the endless heating belt 51 and the hot roller 31 is the maximum z1.

When the eccentric cams 75 are caused to rotate as shown in FIG. 8(*b*), the left side lower areas of the arms 73 are pushed up by the circumferential surface of the eccentric cams 75 and the arms 73 rotate around the support shaft 73*c* such that the left side external hot roller 52 resists the spring force of the springs 74 and rises, and the length (or surface area) of the heating contact region Z between the endless heating belt 51 and the hot roller 31 is reduced to z2.

Figure 9:
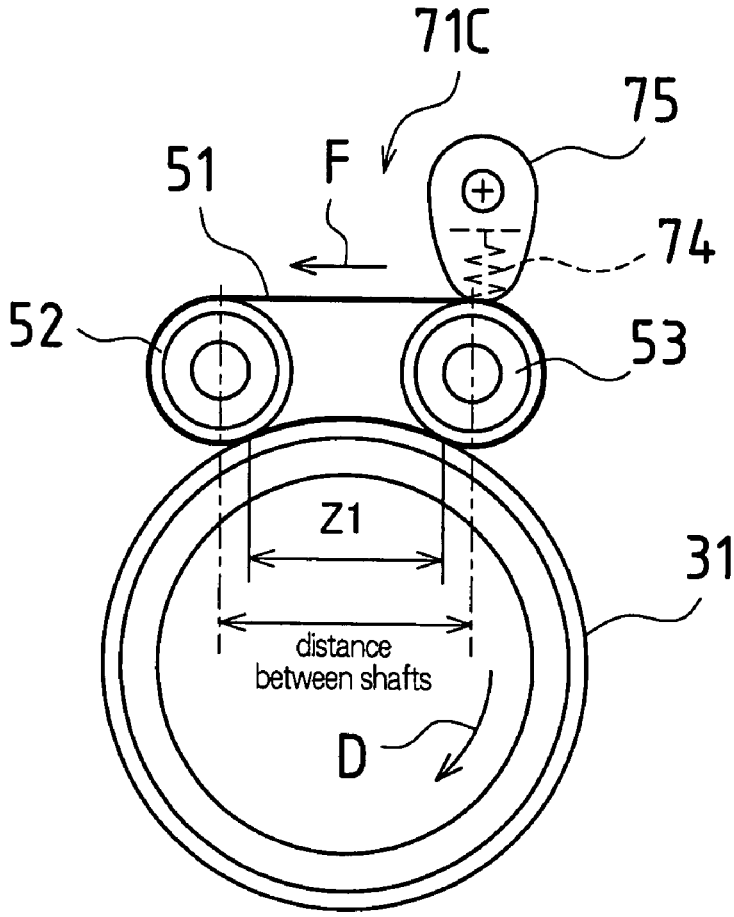
FIG. 9 is side views showing a different modified example of the displacement mechanism in the fixing apparatus of FIG. 2.

FIG. 9 shows a different displacement mechanism. With a displacement mechanism 71C, the shaft of the right side external hot roller 53 is pulled upward by the springs 74, and the eccentric cams 75 are caused to contact the respective shaft ends of the right side external hot roller 53. When the shaft of the right side external hot roller 53 is being pushed furthest down by the eccentric cams 75, the length (or surface area) of the heating contact region Z between the endless heating belt 51 and the hot roller 31 is the maximum z1. Furthermore, when the eccentric cams 75 rotate, the shaft of the right side external hot roller 53 is pulled upward by the springs 74, and the length (or surface area) of the heating contact region Z between the endless heating belt 51 and the hot roller 31 is reduced.

With the displacement mechanisms 71A, 71B, and 71C, the amount of displacement of the support plates 72 is small and the endless heating belt 51 does not move apart from the hot roller 31.

Also, in the above embodiments, a heater lamp is provided in both the hot roller 31 and the pressure roller 32, but a heater lamp may be provided in the hot roller 31 only. Similarly, a heater lamp is provided in both the external hot rollers 52 and 53, but a heater lamp may be provided in only one of these. In this case, when a heater lamp is provided in the left side external hot roller 52, which is on an upstream side from the heating contact region Z, the heated area of the endless heating belt 51 heated by the external hot roller 52 moves immediately to the heating contact region Z, and therefore the hot roller 31 can be heated efficiently. Further still, factors such as the number and locations of the thermistors may be varied as appropriate.

The present invention can be embodied and practiced in other different forms without departing from the gist and essential characteristics thereof. Therefore, the above-described working examples are considered in all respects as illustrative and not restrictive. The scope of the invention is indicated by the appended claims rather than by the foregoing description. All variations and modifications falling within the equivalency range of the appended claims are intended to be embraced therein.

What is claimed is:

1. A fixing apparatus, comprising:

a plurality of fixing rollers that sandwich therebetween and transport a sheet of recording paper while applying pressure and heat to the sheet of recording paper, an external heating member that contacts at least one of the fixing rollers and heats the contacted fixing roller, and a control portion that causes displacement of the external heating member and varies in a stepwise manner a surface area or a length of a contact region between the external heating member and the fixing roller that is in contact with the external heating member, wherein the control portion switches a setting of the external heating member to a first displacement position, a second displacement position, and a third displacement position in response to a standby mode, a color mode, and a monochrome mode of the fixing apparatus.

2. A fixing apparatus, comprising:

a plurality of fixing rollers that sandwich therebetween and transport a sheet of recording paper while applying pressure and heat to the sheet of recording paper, an external heating member that contacts at least one of the fixing rollers and heats the contacted fixing roller, and a control portion that causes displacement of the external heating member to vary in a stepwise manner a surface area or a length of a contact region between the external heating member and the fixing roller that is in contact with the external heating member, and controls a temperature of the external heating member, wherein the control portion switches a setting of the external heating member to a first displacement position, a second displacement position, and a third displacement position in response to a standby mode, a color mode, and a monochrome mode of the fixing apparatus.

3. The fixing apparatus according to claim 1 or 2, wherein the surface area or the length of the contact region between the external heating member, which has been set to the second displacement position in response to the color mode, and the fixing roller that is in contact with the external heating member is less than the surface area or the length of the contact region between the external heating member, which has been set to the third displacement position in response to the monochrome mode, and the fixing roller.

4. The fixing apparatus according to claim 1 or 2, wherein a processing speed for a sheet of recording paper in the color mode is slower than a processing speed for a sheet of recording paper in the monochrome mode.

5. The fixing apparatus according to claim 1 or 2, wherein the control portion performs fine adjustments of a position of the external heating member in a state in which the external heating member has been set to the second displacement position or the third displacement position.

6. The fixing apparatus according to claim 5, wherein the control portion performs fine adjustments of the position of the external heating member in response to a surface temperature of the fixing rollers.

7. The fixing apparatus according to claim 6, wherein the surface temperature of the fixing rollers is detected by a temperature detection means provided on a downstream side from the contact region between the external heating member and the fixing roller in a rotational direction of the fixing roller that contacts the external heating member.

8. The fixing apparatus according to claim 1 or 2, wherein the surface area or the length of the contact region between the external heating member, which has been set to the first displacement position in response to the standby mode, and the fixing roller that is in contact with the external heating member is zero.

* * * * *